US009326626B2

(12) United States Patent
Chein

(10) Patent No.: US 9,326,626 B2
(45) Date of Patent: May 3, 2016

(54) TABLEWARE ANCHORING TRAY

(71) Applicant: Daniel W. Chein, San Francisco, CA (US)

(72) Inventor: Daniel W. Chein, San Francisco, CA (US)

( * ) Notice: Subject to any disclaimer, the term of this patent is extended or adjusted under 35 U.S.C. 154(b) by 32 days.

(21) Appl. No.: 14/461,237

(22) Filed: Aug. 15, 2014

(65) Prior Publication Data

US 2016/0045044 A1 Feb. 18, 2016

Related U.S. Application Data

(60) Provisional application No. 61/899,047, filed on Nov. 1, 2013.

(51) Int. Cl.
*A47G 19/08* (2006.01)
*B65D 21/02* (2006.01)

(52) U.S. Cl.
CPC ..... *A47G 19/08* (2013.01); *B65D 21/0209* (2013.01)

(58) Field of Classification Search
CPC ..... A47G 19/08; B65D 21/0209
USPC ..... 220/694, 729, 735, 737, 4.01, 4.28, 220/23.86; 206/565
See application file for complete search history.

(56) References Cited

U.S. PATENT DOCUMENTS

| | | | | |
|---|---|---|---|---|
| 3,847,324 | A | 11/1974 | Uchanski et al. | |
| 3,922,455 | A | 11/1975 | Brumlik | |
| 4,534,469 | A * | 8/1985 | Elsmo | 206/560 |
| 5,058,737 | A * | 10/1991 | Patterson et al. | 206/217 |
| 5,240,136 | A * | 8/1993 | Patterson | A47G 19/065 206/217 |
| 5,356,008 | A * | 10/1994 | Chung | 206/449 |
| 5,586,800 | A * | 12/1996 | Triplett | 297/148 |
| D409,049 | S | 5/1999 | Millard | |
| 6,062,418 | A * | 5/2000 | Rathjen | 220/574 |
| 7,608,070 | B2 | 10/2009 | Chen et al. | |
| 8,262,039 | B2 | 9/2012 | Royka | |
| 8,439,200 | B1 * | 5/2013 | Sorrells et al. | 206/565 |
| 2006/0218795 | A1 | 10/2006 | Santa Cruz et al. | |

* cited by examiner

*Primary Examiner* — Robert J Hicks
*Assistant Examiner* — Kareen Thomas
(74) *Attorney, Agent, or Firm* — David E. Newhouse, Esq.

(57) ABSTRACT

A tray for picnics and buffets that secures and stabilizes (anchors) tableware items is described that has a planar tray top with crossing inverted T-slots openings that accommodate anchoring slider tabs that present top attachment surfaces adapted for securing and anchoring tableware placed on the tray top at variable positions along the inverted T-slots. The bottom of the describe tray has an integral downturned peripheral rim sized slightly greater than the planar tray tops enabling a number of such trays to be stably stacked and stored.

9 Claims, 12 Drawing Sheets

TABLEWARE ANCHORING TRAY

RELATED APPLICATIONS

This Application claims all benefits applicable under 35 U.S.C.§119(e) related to U.S. Provisional Patent Application Ser. No. 61/899,047 filed by the Applicant on 1 Nov. 2013 entitled "TABLEWARE ANCHORING TRAY", and incorporates U.S. Provisional Patent Application Ser. No. 61/899,047, in its entirety, by reference into this application.

BACKGROUND OF THE INVENTION

1. Field of the Invention

The present invention generally relates to trays, in particular stackable food trays having inverted T-slot channels for receiving anchoring slider tabs presenting top attachment surfaces adapted for securing disposable tableware on the top surface of the tray.

2. Description of the Prior Art

Wind and disposable tableware such as plastic and/or paper plates, dishes, cups, utensils and napkins have historically plagued outdoor picnickers. Also, the stability of tableware generally in buffets is a problem where patrons are required to hold, and balance two or more tableware items while self-serving, or being served at food stations and then transporting the prospective meal to a suitable location for dining.

Various approaches addressing the problems of stabilizing and handling disposable tableware include shaped, double-stick pads each with protective release liners/membranes where one adhesive surface is stuck onto a bottom surface of a tableware piece or holder and the other is stuck on a stationary surface. (See U.S. Pat. No. 3,847,324, Uchanski, et al). With the evolution of hook and loop fastener systems, landing surfaces composed of fibrous loop materials are placed and secured on a stable surface, e.g. a picnic table, for engaging pads stuck onto the bottoms of the tableware pieces or holders presenting a surface of projecting struts or hooks adapted to interlock with the fibrous loops (See. U.S. Pat. No. 3,922,455, Brumilk; U.S. Pat. No. 7,608,070; Chen et al. & U.S. Pat. No. 8,262,039, Royka. (See also, U.S. Patents in classified in subject matter U.S. USPC categories 428/98-428/100 and International categories CPC A44B 18/00 et seq.)

For buffets, the approach has been trays, in particular compartmented food servers generally classified in USPS class categories D07/550-555, and in International Industrial Design LOC. class category (10) 07/C0003, e.g. U.S. Pat. No. D409049, Millard. (See also US 2006/0218795, Santa Cruz et al.)

As pointed out in Royka (supra at Col. 1, 11. 25-28) double-sided adhesives tend to leave sticky residues that sometimes are difficult to remove. The Royka solution, a secured table cover providing fibrous loop landing areas for engaging pads stuck onto the bottoms of tableware for securing the tableware both doubles the number tabled pieces, and creates tablecloth cleaning issues (spilled food and drink). The problem with trays heretofore has been stabilization of tableware containing food servings generally on a flat surface. Compartmented food servers are essentially trays with compartments shaped to receive, hold and contain particular tableware pieces and/or servings in pre-determined positions on a top surface.

SUMMARY OF THE INVENTION

A tray for picnics and buffets that secures and stabilizes (anchors) tableware items is described that has a planar tray top with crossing inverted T-slots openings that accommodate anchoring slider tabs that present top attachment surfaces adapted for securing and anchoring tableware placed on the tray top at variable positions along the inverted T-slots. The bottom of the describe tray has an integral downturned peripheral rim sized slightly greater than the planar tray tops enabling a number of such trays to be stably stacked and stored.

DESCRIPTION OF PREFERRED AND EXEMPLARY EMBODIMENTS

Figure 1A:
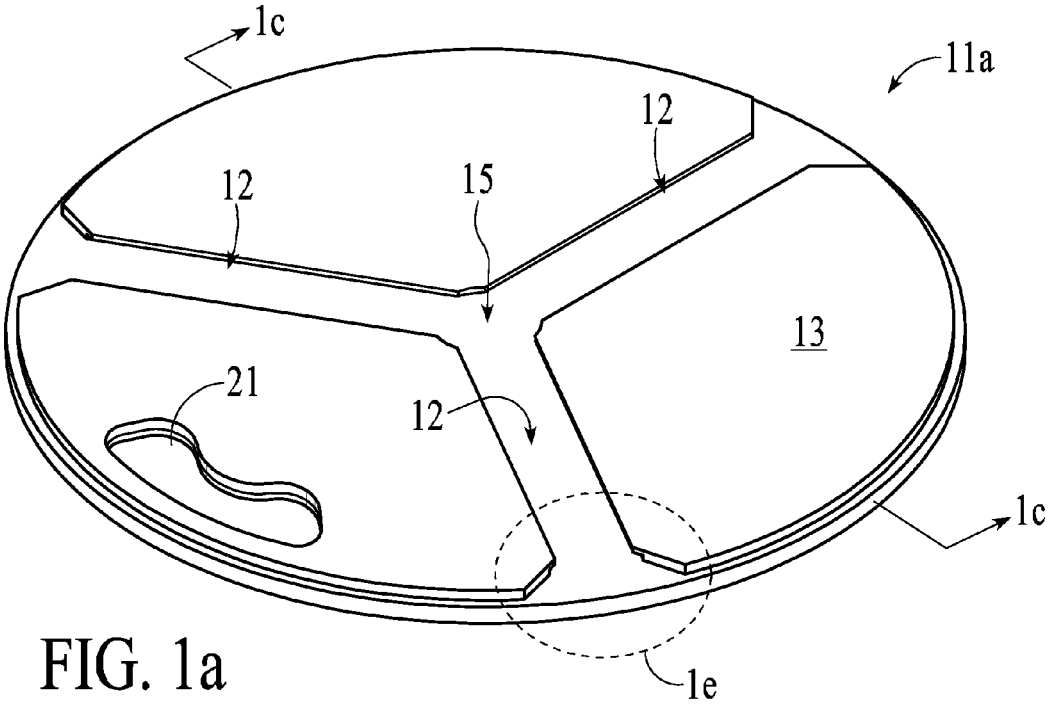
FIGS. 1*a* and 1*b* present perspective views respectively of a top and bottom of a round picnic tray with three, inverted, radial T-slots dividing the planar tray top in to thirds.
Figure 1B:
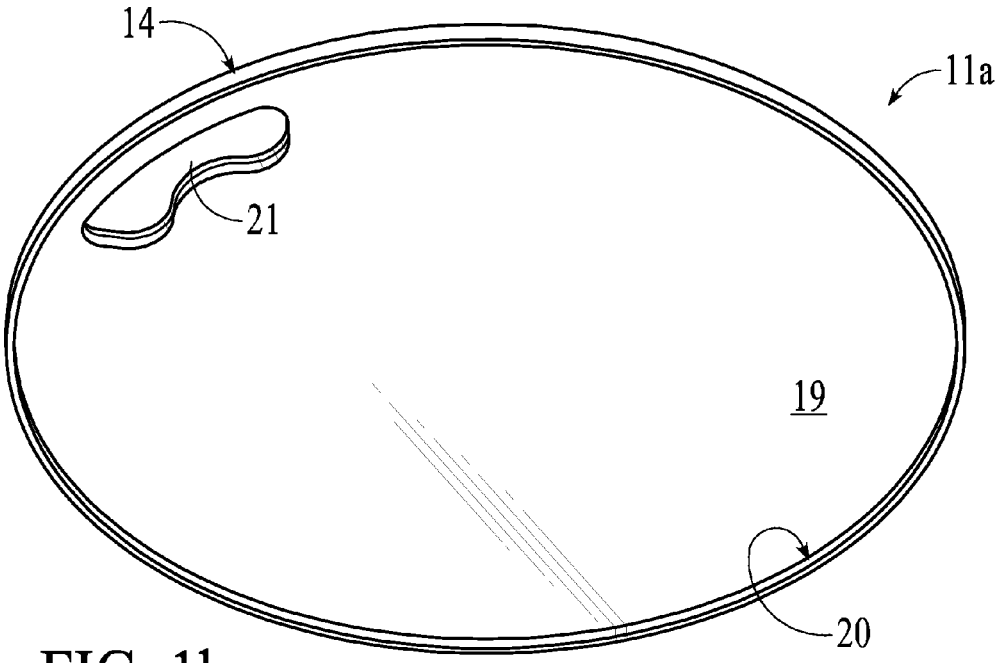

FIGS. 1*a*-1*f* and FIGS. 2*a*-2*c* show the details of a round picnic tray 11*a* and a rectangular buffet tray 11*b*. Each tray has three, inverted T-slots 12 extending across the planar tray tops 13. The round picnic tray 11*a* has three radial inverted T-slots 12 that extend from the tray periphery 14 to the tray center 15 spaced equidistant around the tray periphery 14 dividing the tray top 13 into thirds. The rectangular buffet tray 11*b* (FIGS. 2*a* & 2*b*) has an inverted T-slot 12*a* crossing the planar tray top 13 spaced inward from, and parallel to the front side 17 of the tray, and two angularly intersecting inverted T-slots 12*c* & 12*c* extending from the back corners 18 of the tray. The inverted T-slots 12*a*-12*c* essential divide the planar tray top 13 of the rectangular buffet tray 11*b* into four regions.

The bottoms 19 of both the picnic and buffet trays 11*a* & 11*b* preferably include an integral downturned rim 20 (FIGS. 1*c* & 2*b*) with inside dimensions slightly greater than those of the planar tray top 13 such that a number of such trays 11*a* or 11*b* can be stably stacked and stored, one-a-top-another. A handling aperture 21 appropriately configured and sized to accommodate a human hand is located proximate the periphery 14 of picnic tray 11*a*.

Figure 1C:
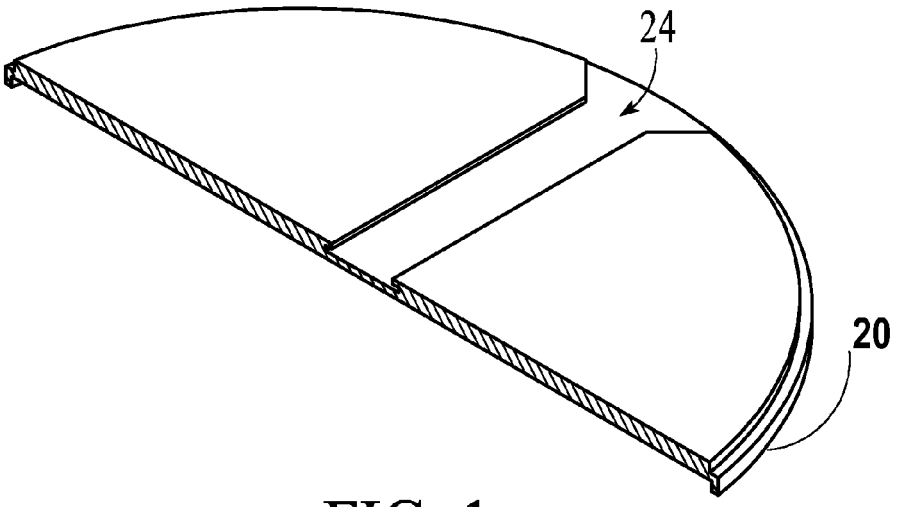
FIG. 1*c* is a perspective cut-away cross-section A-A of the round tray shown in FIG. 1*a*.
Figure 1D:
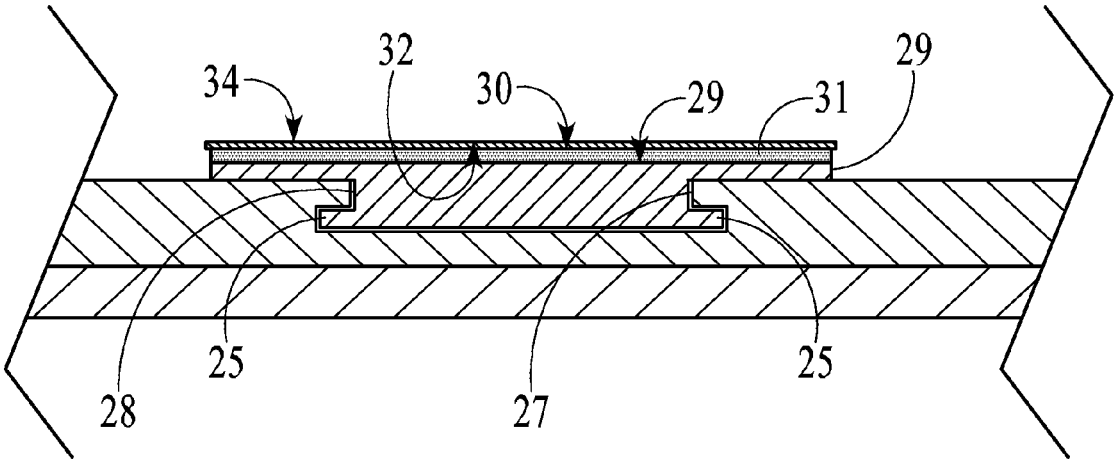
FIG. 1*d* is an enlarged detail cross-section of an exemplary anchoring slider tab received in an inverted T-slot.
Figure 1E:
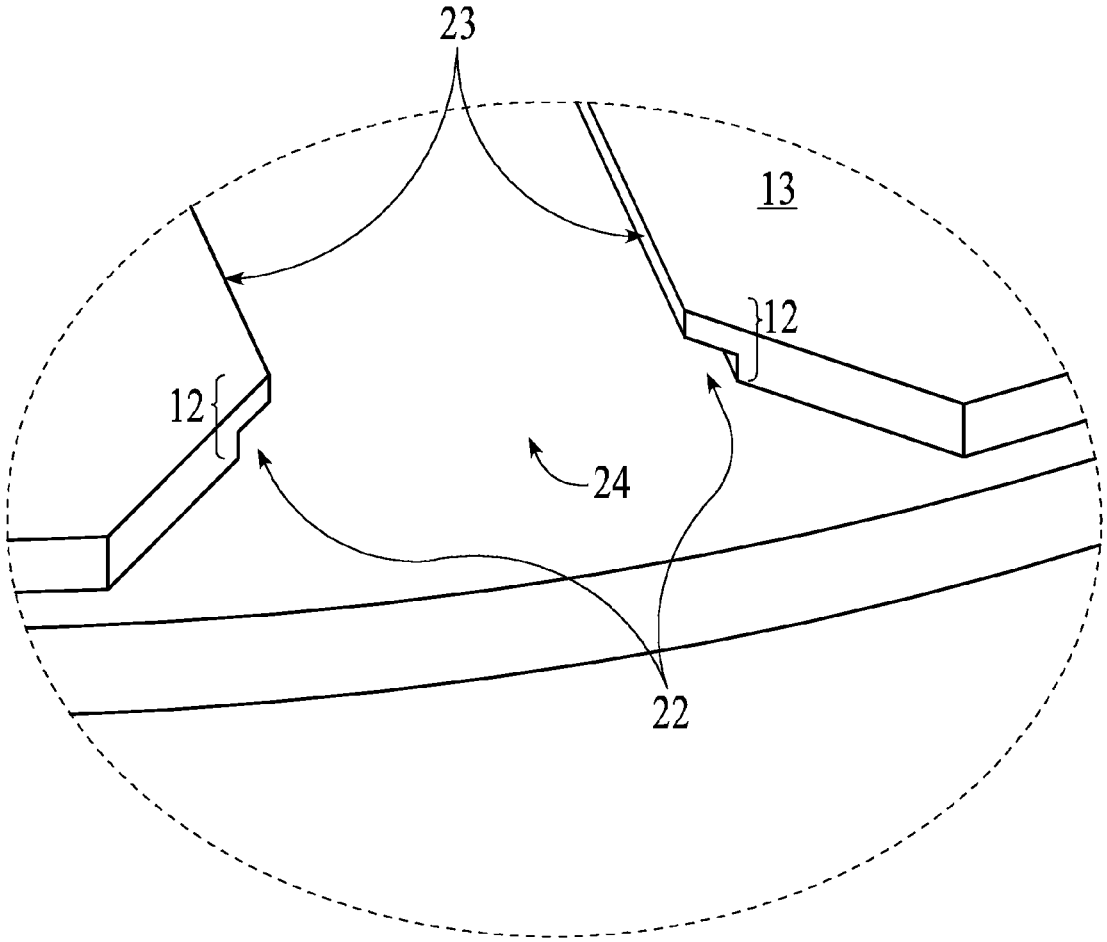
FIG. 1*e* is an enlarged perspective detail view of an inverted T-slot opening at the periphery of the round picnic tray.
Figure 1F:
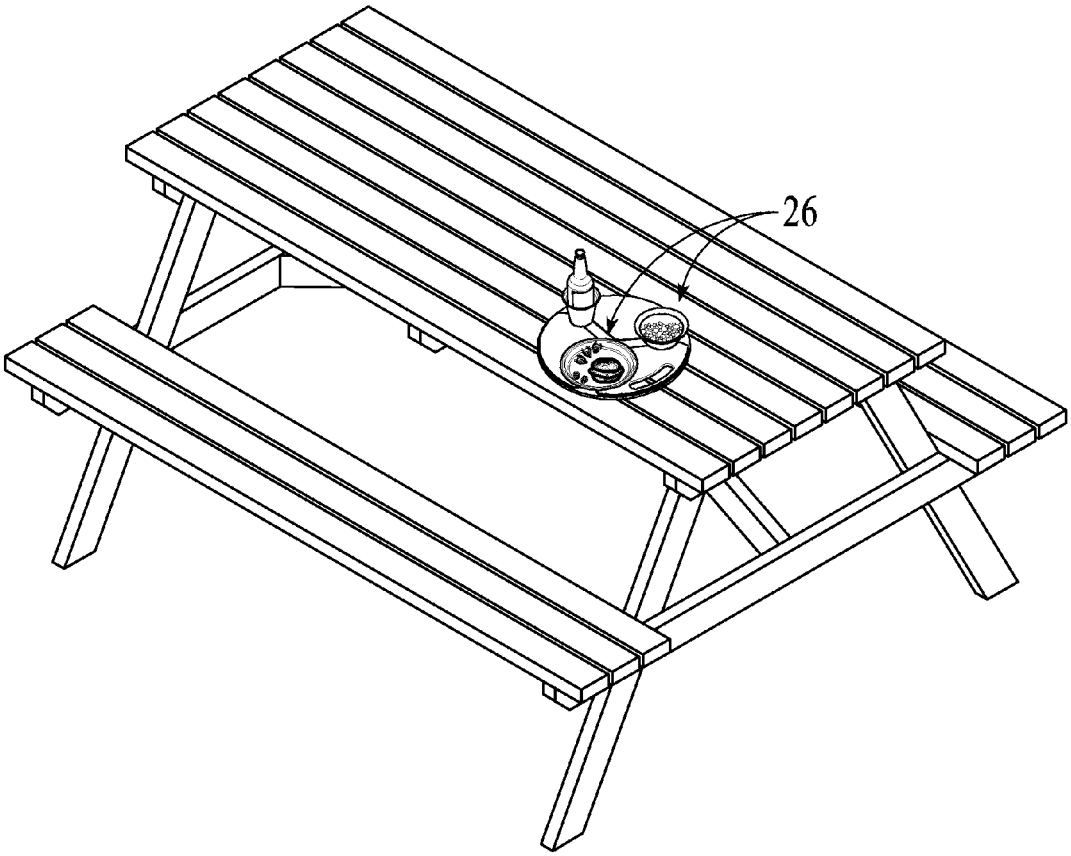
FIG. 1*f* illustrates the round tray shown resting on a picnic table anchoring a cup/bottle holder, a disposable plate and bowl respectively containing a bottle and food servings.
Figure 2A:
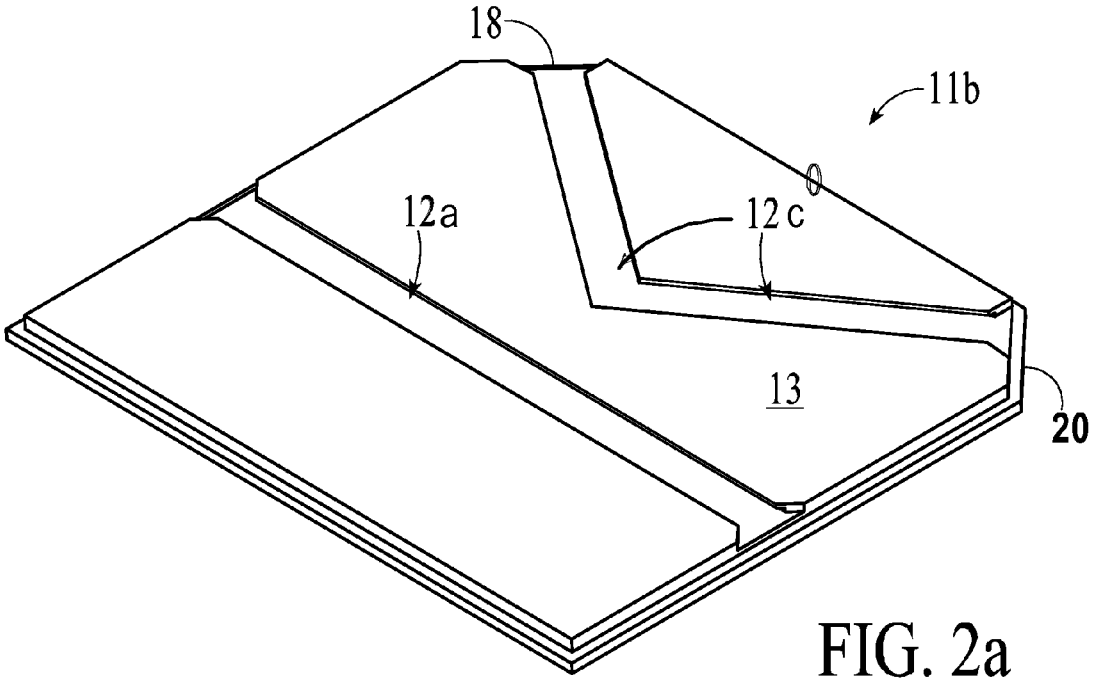
FIGS. 2*a* and 2*b* present perspective views respectively of the top and bottom of a rectangular buffet tray with three inverted T-slots.
Figure 2B:
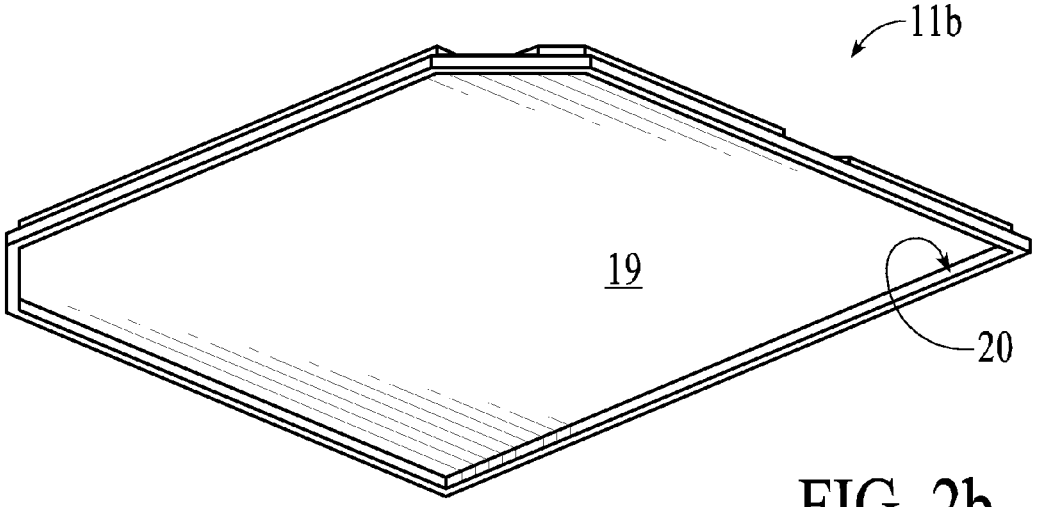
Figure 2C:
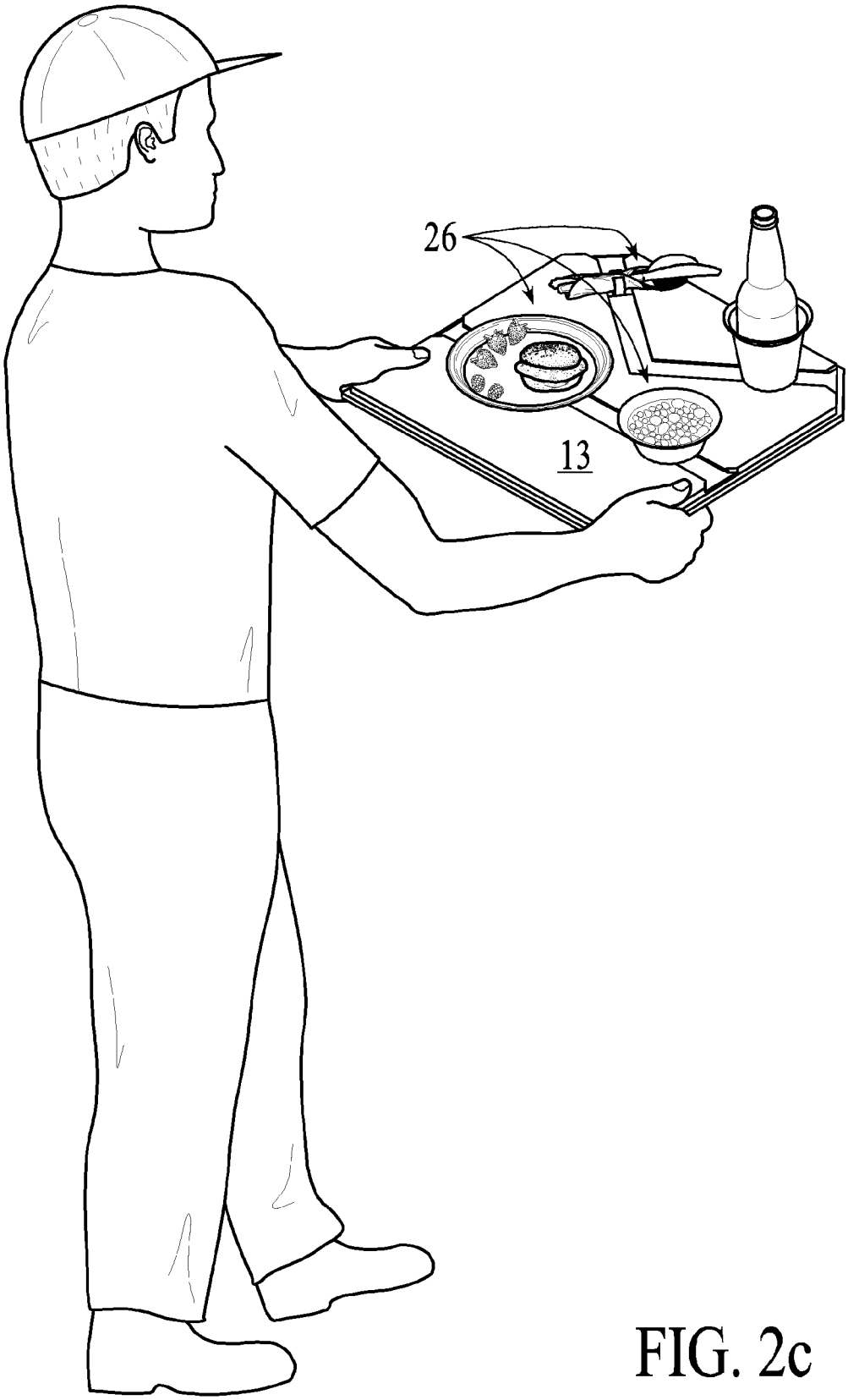
FIG. 2*c* illustrates a person walking with the buffet tray loaded with food.
Figure 3A:
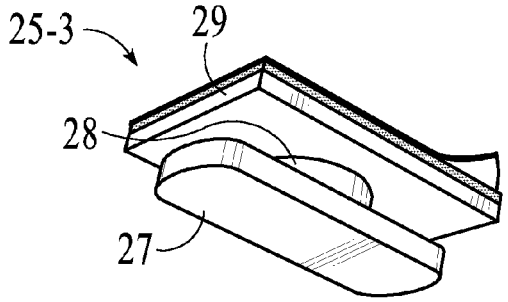
FIGS. 3*a*-3*d*, FIGS. 4*a*-4*c*.
Figure 3B:
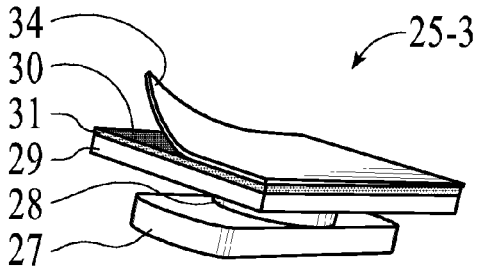
Figure 3C:
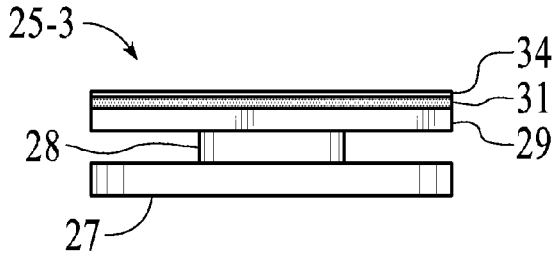
Figure 3D:
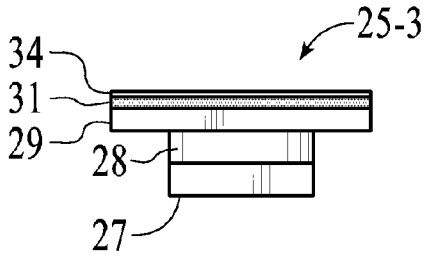
Figure 4A:
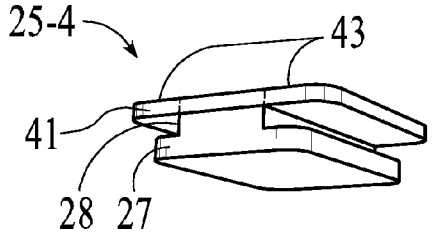
Figure 4B:
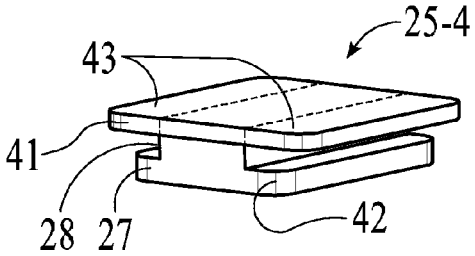
Figure 4C:
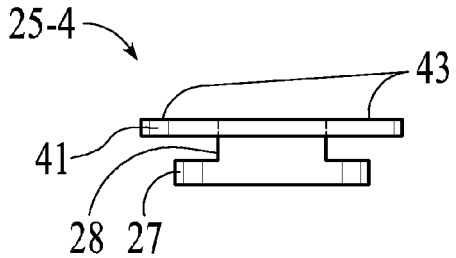
Figure 4D:
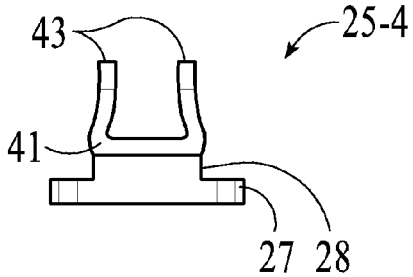
Figure 5A:
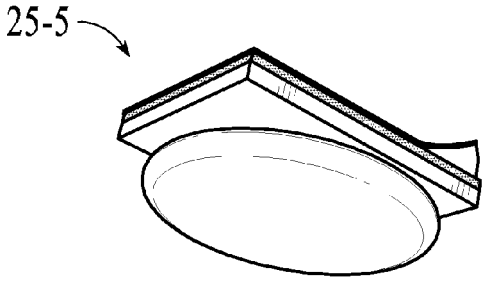
FIGS. 5*a*-5*d* and FIGS. 6*a*-6*d* illustrate details of various embodiments of anchoring slider tabs adapted to frictionally slide within the inverted T-slots crossing the planar tray tops of the picnic and buffet trays where the slider top presents an attachment surface adapted to anchor tableware placed on the top surface of the trays.
Figure 5B:
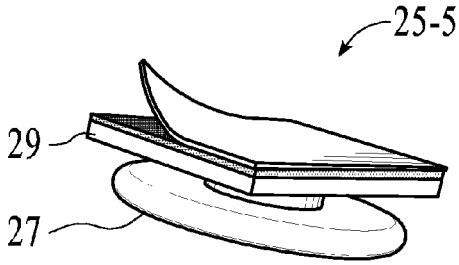
Figure 5C:
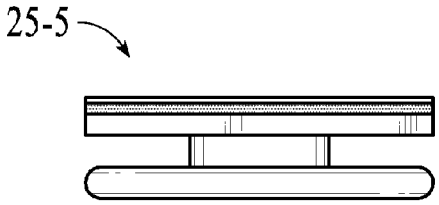
Figure 5D:
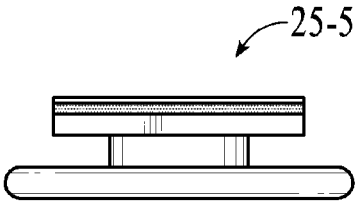

As shown in FIGS. 1*c*-1*e*, each inverted T-slot 12 consists of a wide horizontal channel 22 parallel the planar tray top 13 within the body of the tray 11 with a narrower central vertical slot opening 23 that extends either across or partially across the planar tray top 13 with at least one entrance opening 24 on the tray periphery 14. The entrance openings 24 of the inverted T-slots 12 at the periphery of the trays 11*a* & 11*b* are beveled outward at the periphery of a tray 11 to facilitate introduction of anchoring slider tabs 25 into the T-slots. The anchoring slider tabs 25 are then slid to positions along particular inverted T-slots for securing and anchoring tableware placed on slider tabs 25 at desired positions. (See FIGS. 1*f* & 2*c*.)

In more detail, looking at FIG. 1*d*, suitable anchoring slider tabs 25 have a slider base 27 dimensionally sized for sliding within the horizontal channel 22 of the inverted T-slots 12, a vertical stem section 28 each having a cross-section diameter dimension sized for lightly engaging an interior surface of the inverted T-slots 12 and a top panel 29 bridging over the slot opening 23 on the planar tray top 13. The top panel 29 of the anchoring slider tab 25 presents an adhesive attachment surface 30 preferably consisting of a double-sided adhesive membrane 31 with a top sticky adhesive surface 32 protected by a removable release membrane 34. The anchoring slider tabs 25 can be introduced into the inverted T-slot 12 principally via the slot entrance 24 at the tray periphery 14 (FIG. 1*e*) or, if properly configured, via the vertical slot opening 23 in the planar tray top 13.

Figure 7A:
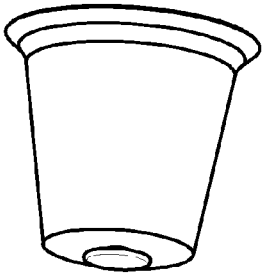
FIGS. 7*a*-7*c* illustrate details of a cup/bottle holder with a bottom slider tab sized for snugly sliding within inverted T-slots of the respective trays.
Figure 7B:
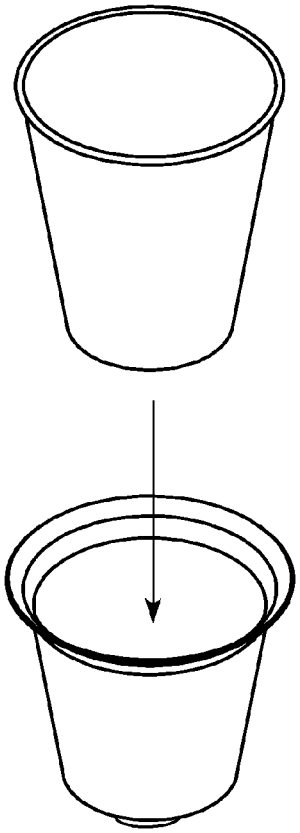
Figure 7C:
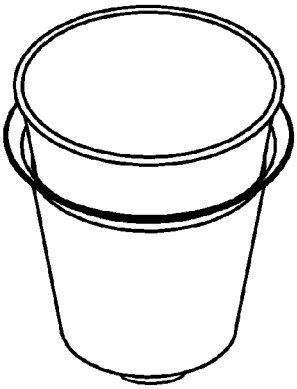
Figure 8:
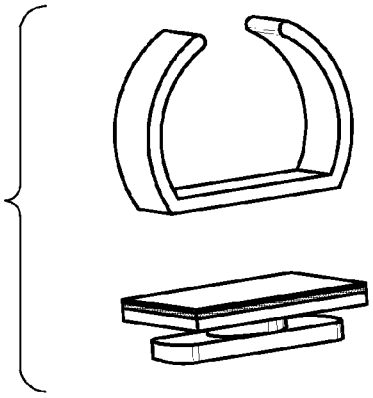
FIG. 8 illustrates a combination of a utensil holder adapted for holding eating utensils wrapped in a napkin and a bottom slider tab sized for snugly sliding within the inverted T-slot for anchoring it on the surface on the surface of the picnic/tableware tray.
Figure 9:
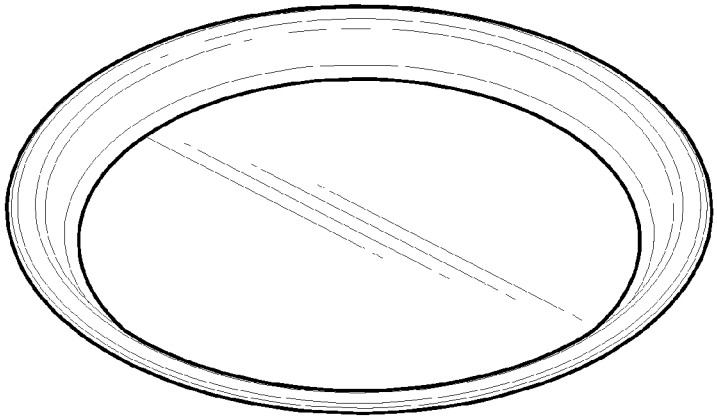
FIGS. 9 and 10 present bottom perspective views, respectively, of a typical disposable plate and disposable dish.
Figure 10:
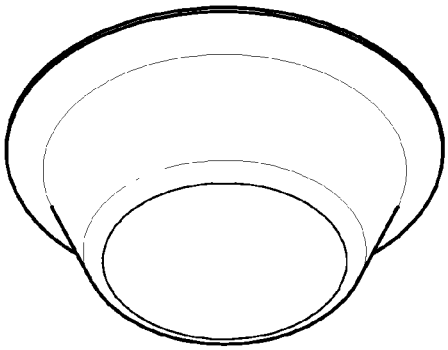

FIGS. 3*a*-3*d* depict a rotatable anchoring slider tab 25-3 that is oblong having width dimensions of the slider base 27 and slider stem 28 sized to be received through the vertical slot opening 23 on the tray top 13 of an inverted T-slot 12, and length dimensions sized for frictionally anchoring the slider tab within the inverted T-slots 12 when rotated 90°. In particular, anchoring slider tab 25-3 can be mounted in an inverted T-slot 12 via the vertical slot opening 23 at any point along an inverted T-slot 12. The slider is then rotated 90° to orient both the oblong slider base 24 and the oblong slider stem 28 to frictionally engage the walls of the horizontal channel 22 and the sides of the vertical slot opening 23 of the T-slot. The top panel 29 of anchoring slider tab 25-3 bridges across the slot opening 23. The advantage of the oblong anchoring slider tab 25-3 is that it can be placed in the inverted T-slot 12 at any point along the slot on the planar tray top 13 and twisted 90° to lock it in place. The release membrane 34 can then be removed, exposing the adhesive surface 32 and particular tableware piece 26 can be placed on it (FIGS. 1*f* & 2*c*) anchoring the piece in place on the tray top 13. Subsequently, the tableware piece can be rotated 90° and removed from planar tray top 13 along with the anchoring slider tab 25-3. The top panel 29 need not be oblong as illustrated, but can be variously sized and shaped for adhering to bottoms of particular tableware pieces (see FIG. 7).

FIGS. 4*a*-4*d* depict an anchoring slider tab 25-4 embodiment with a flexible pad 41 as a top panel 29 secured on top of the stem 28 with a rectangular slider base 27 and stem 28 of the same length both with rounded corners 42 allowing the slider tab 25-4 to slide without binding in the inverted T-slot 12 but not rotate. The flexible pad 41 presents a top adhesive surface protected by a removable release membrane (not shown) similar to the illustrations of FIGS. 3*a*-3*d*, and has a width at least equal to the length of the slider tab 25-4 and a length at least sufficient to bridge across the vertical slot opening 23. The advantage of the anchoring slider tab 25-4 is that the wings 43 of the flexible pad panel 41 overhanging the stem 28 can be folded upward (FIG. 4*d*) and held between a human thumb and forefinger before the protective release membrane 35 is removed for introducing the slider tab 25-4 into the inverted T-slot entrance 24 at the tray periphery 14 (see FIG. 1*e*), then sliding the anchor slider 25-4 to a desired position on the planer tray top 13 along the particular inverted T-slot for anchoring a tableware piece 26. Another advantage of an anchoring slider tab 25-4 is that the flexible pad 41 panel top flexes upward responsive to a external forces (wind) protecting against peel failure of the adhesive bond between a tableware piece and an anchoring tab.

FIGS. 5*a*-5*d* depict an anchoring slider tab 25-5 with a round base 27 having a diameter slightly less than the width of the horizontal channel 22 of the inverted T-slots 12 and a round stem having a diameter sized for lightly frictionally engaging the sides of the vertical slot opening 23. Slider tab 25-5 is introduced into the inverted T-slot entrance 24 at the tray periphery 14 of a particular inverted T-slot 12. As above, the top panel 29 of slider tab 25-5 bridges over the slot opening in the planar tray top and may be may be variously configured for adhering to and anchoring particular tableware pieces 22. The advantage of anchoring tab 25-5 is that an anchored tableware piece can be rotated on the planar tray top 13.

Figure 6A:
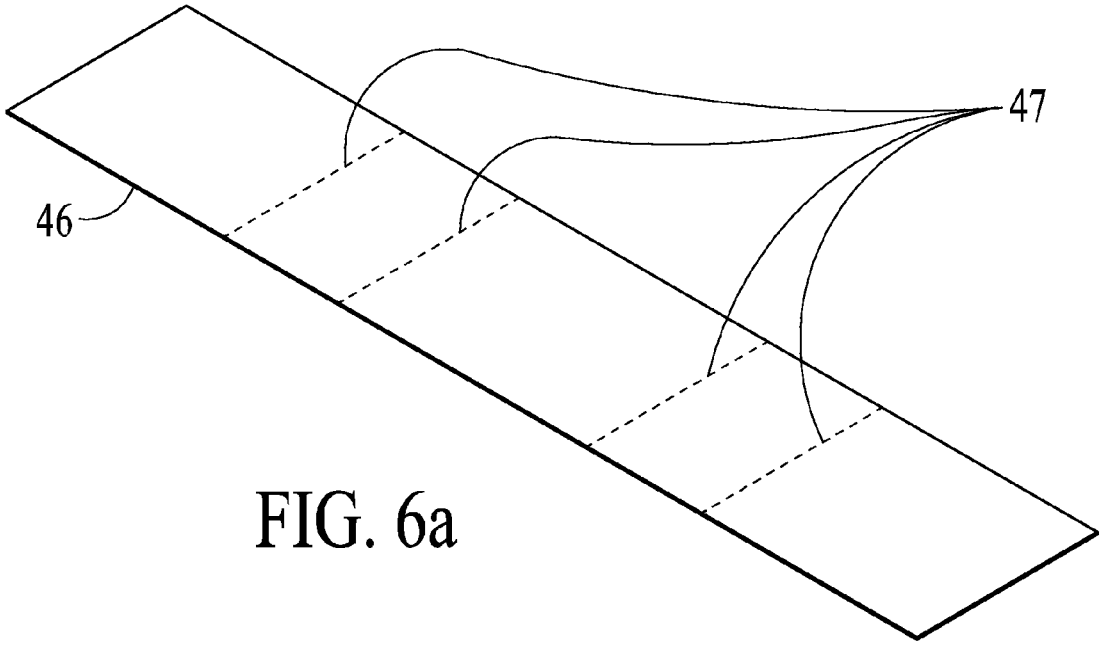
Figure 6B:
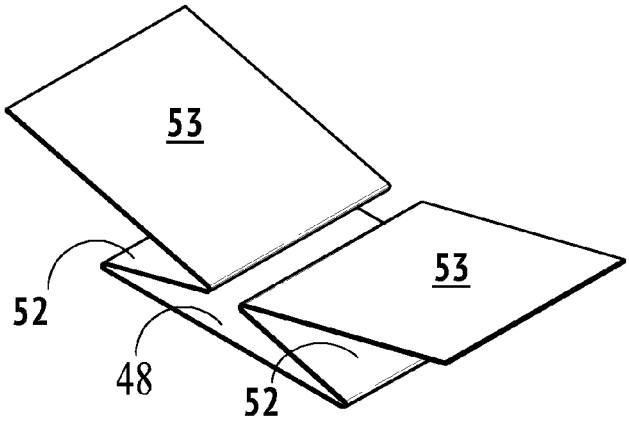
Figure 6C:
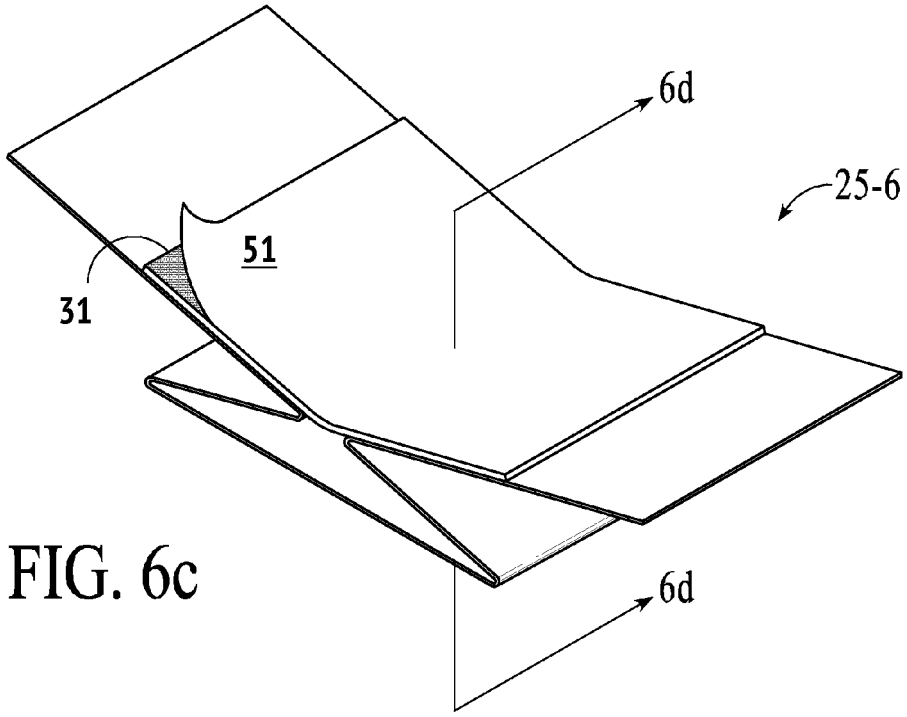
Figure 6D:
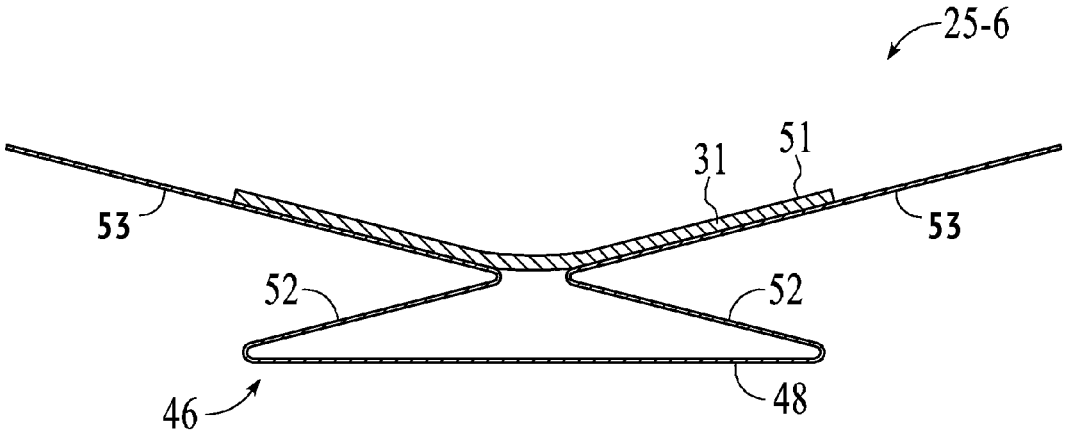

FIGS. 6*a*-6*d* depict a preferred anchoring slider tab 25-6 fabricated by symmetrically folding a relatively rigid/stiff paper strip 46, indicated by the fold lines 47 in FIGS. 6*a* & 6*b*, first inward for forming inward folded panels 52 and a bottom panel 48, sized for sliding within the horizontal channel 22 of the inverted T-slots 12, and then outward forming wing panels 53. A double-sided adhesive membrane 31 with a top release membrane 51 secures the outward folded wing panels 53 together centered above the bottom panel 48 such that wing panels 53 extend upward presenting a V-top panel 29 that bridges over the slot opening 23. More specifically, length of the inward folded panels 52 of slider tab 25-6 are slightly less than one-half (½) the length of the bottom panel 48 such that when secured together at the folds by the double-sided adhesive membrane 31, the bottom panel 48 bows slightly tensioning the inward folded panels 52 such that inward folded panels 52 and wing panels 53 spring up from the bottom panel 48 forming a base of the slider tab 25-6 that ideally, frictionally engages the underside and bottom and top edges of the overhanging shoulders of the inverted T-slots 12 and the top surface of the tray 11 when adhered to the bottom of a tableware piece for anchoring it in place on the top surface of the tray 11

Returning to FIG. 1*e*, shown is an enlarged perspective top view of the tray periphery 14 at an T-slot entrance 24 where the planar tray top 13 is recessed a step inward from actual tray periphery 14 that encompasses a downturned rim 20 (see FIGS. 1*c* & 2*b*) sized slightly larger than the planar tray top 13 such that a number of such trays 11 can be stably stacked and stored, one-a-top-another. A skilled product designer should appreciate the configuration of the tray periphery 14 from the planar tray top to the actual outside edge of the tray body can be smoothly curved downward rather than stepped.

The product designer should also understand that conventional stacking trays with top rims sized for nesting tray bottoms could also be provided with inverted T-slots crossing the tray top with peripheral entrances. However, the slider tabs 25 used with tray with top rims would be limited to those sized to be received through the vertical slot opening of the inverted T-slots crossing the tray top of the (FIGS. 3*a*-3*d*), or having foldable top panels (FIGS. 4*a*-4*d* & FIGS. 6*a* & 6*e*) for allowing the slider tab entry introduced via inverted T-slot entrance at the tray periphery. Alternatively, the entrance openings of the inverted T-slots at the periphery of top rim trays could be beveled outward at the periphery of the tray cutting away at the tray top rim sufficiently with to allow entry of the slider tab into the inverted T-slot.

Design Factors Considered:

A skilled product designer should appreciate that the width and depth of the inverted T-slots 12 crossing the planar tray tops 13 of a tray 11 and the cross-section dimensions of the tab stems 28 are dependent on competing factors, e.g., the ease of introducing and sliding the anchoring slider tabs 28 within the inverted T-slots 12 into position on the planar tray top 13 versus the frictional resistance necessary for securing a tableware pieces loaded with food servings when the tray 11 is tipped slightly or bumped. If the frictional resistance is too great there is a risk that the top panel 29 of a tab 25 can be torn from the stem 28 of the slider tab 25. On the other hand, if the frictional resistance is minimal there is a risk that the slider tab 25 securing a tableware piece may slide out of the inverted T-slot 12 when the tray is bumped or tipped.

Also it is desirable to easily locate one or more anchoring slider tabs 25 on the tray top 13 secured within an inverted T-slot 12 at particular positions along the slot for anchoring a particular item of tableware. The release membranes 34 must removed too for exposing the adhesive surfaces 32 on the top panel 29 of the anchoring slider tab(s) 25 without pulling the slider tab(s) 25 out of the inverted T-slot 12 or ripping the top panel 29 off the slider tab stem 28.

Weighing these factors, the width of the vertical slot 23 of the inverted T-slots 12 should at least be sufficient to accommodate a human forefinger and thumb so that the base 27 of an anchoring slider tab 25 can be grasped and introduced into the inverted T-slot 12 at the tray periphery 14 and moved to desired position(s) along a particular inverted T-slot on the planar tray top 13 before anchoring a particular tableware piece, e.g., a plate (FIGS. 1*f* & 2*c*) on the top adhesive surface 32 of one or more slider tabs. Having the width of the slot opening 23 sized for accommodating a human forefinger and thumb also allows the anchoring slider tab 25 to be held as the release membrane is lifted off the surface of the adhesive layer 32.

The depth of the inverted T-slots 12 is predicated by the integrity the overhanging shoulder lands establishing the vertical slot opening 23 above the horizontal channel of the inverted T-slot securing the base 27 of the anchoring slider tab 25 depends on structural properties of the tray material and thickness of the lands.

Finally, it is helpful to realize one or more anchoring slider tabs 25 can be used and strategically located in one or more inverted T-slots 12 for more securely anchoring a tableware piece 26 in a position on the planar top of the tray 11.

I claim:

1. A food tray for anchoring tableware comprising in combination:

a) a tray body presenting a planar top surface, a bottom surface and a periphery having at least one inverted T-slot extending from the periphery of the tray body at least partially across the planar top surface of the tray body having a wide horizontal base channel within the tray body parallel to the planar top, and a narrow vertical slot channel opening through the planar top surface of the tray body; and b) at least one anchoring slider tab having a wide slider base, a wider planar top and a stem section joining the slider base to the slider top dimensioned for sliding within the inverted T-slot frictionally engaging interior surfaces of the inverted T-slot, and c) an attachment surface adapted for securing tableware is adhered on the planar top surface of the anchoring slider tab.

2. The food tray of claim 1 where the narrow slot opening of the inverted T-slot at the periphery of tray body is beveled outward to at least equal the width of the horizontal base channel.

3. The food tray of claim 1 where the narrow slot opening of the inverted T-slot at the periphery of the tray body is beveled outward to at least equal the width of the wide planar base of anchoring slider tabs.

4. The food tray of claim 1, 2 or 3 wherein the bottom surface of the tray body includes an integral downturned rim with inside dimensions slightly greater than those of the planar top body of the tray, whereby a plurality of the trays can be stably stacked and stored, one-a-top-another.

5. The food tray of claim 4 wherein the tray body is rounded and has at least three inverted T-slots extending from the tray periphery spaced equidistant around the tray periphery, intersecting at a central intersection dividing the top surface of the tray into thirds, and wherein the narrow slot openings of the intersecting inverted T-slots at the central intersection are beveled outward to at least equal the width of the wide planar base of anchoring slider tabs.

6. The food tray of claim 5 further including a handling aperture appropriately configured and sized to accommodate a human hand located proximate the periphery of the tray body.

7. The food tray of claim 4 wherein the tray body is rectangular and has an inverted T-slot crossing the planar tray top (13) spaced inward from, and parallel to a front side of the tray body, and two angularly intersecting inverted T-slots extending from back corners of the tray body.

8. A slider tab for anchoring tableware on a planar support surface with an inverted T-slot having a horizontal channel with a narrower slot opening extending across the planar support surface comprising in combination:

a) a relatively rigid/stiff paper strip with end sections folded symmetrically inward for forming a base panel section sized wider than the narrow slot opening for sliding within the horizontal channel of the inverted T-slot and then folded outward for forming top wing panel sections;

b) a flexible double-sided adhesive membrane with a top release membrane adhered to top surfaces of the outward folded top wing panel sections securing them together centered above the base panel section slightly bowing the bottom panel section, for inducing the folded top wing panel sections of the strip to spring upward presenting a V-top for bridging over the slot opening of the T-slot; whereby, when introduced into the horizontal channel of the inverted T-slot, the slider tab frictionally engages inner surfaces of the inverted T-slot and the planar support surface for anchoring a tableware piece on the support surface when the top release membrane is removed from the double-sided adhesive membrane and a tableware piece is placed on and is adhered to the adhesive membrane.

9. The slider tab of claim 8 wherein the top wing panel sections jointly have a width greater than that of the base panel section.

* * * * *